US010690153B1

(12) United States Patent
LeBlanc et al.

(10) Patent No.: US 10,690,153 B1
(45) Date of Patent: Jun. 23, 2020

(54) HYDRAULIC MANIFOLD CONTROL ASSEMBLY

(71) Applicant: Stella Maris, LLC, Lafayette, LA (US)

(72) Inventors: Ryan A. LeBlanc, Youngsville, LA (US); Paul W. Stutes, Lafayette, LA (US); Ryan S. Gary, Carencro, LA (US); Michael P. Menard, Church Point, LA (US); Jacob R. Denison, Carencro, LA (US); Luis A. Chinchilla, Lafayette, LA (US); Calvin R. Williamson, Youngsville, LA (US); Devi Satish Chandra Mallavalli, Lafayette, LA (US); Ryan J. Dugas, Lafayette, LA (US); James G. Ray, Carencro, LA (US); Clay S. Hulsey, Iota, LA (US)

(73) Assignee: Stella Maris, LLC, Lafayette, LA (US)

( * ) Notice: Subject to any disclaimer, the term of this patent is extended or adjusted under 35 U.S.C. 154(b) by 85 days.

(21) Appl. No.: 16/148,619

(22) Filed: Oct. 1, 2018

Related U.S. Application Data

(62) Division of application No. 15/348,934, filed on Nov. 10, 2016, now Pat. No. 10,087,959.
(Continued)

(51) Int. Cl.
*F15B 13/02* (2006.01)
*E21B 34/16* (2006.01)
(Continued)

(52) U.S. Cl.
CPC ..... *F15B 13/022* (2013.01); *E21B 33/063* (2013.01); *E21B 34/16* (2013.01); *F15B 13/081* (2013.01); *F15B 13/0814* (2013.01); *F15B 21/02* (2013.01); *F15B 13/0825* (2013.01); *F15B 13/0896* (2013.01); *F15B 2013/006* (2013.01)

(58) Field of Classification Search
None
See application file for complete search history.

(56) References Cited

U.S. PATENT DOCUMENTS 3,327,733 A * 6/1967 Doig ..... F16K 27/003 137/552
4,399,836 A * 8/1983 de Versterre ..... F15B 13/0405 137/487.5
(Continued)

*Primary Examiner* — John Fox
(74) *Attorney, Agent, or Firm* — Intellectual Property Counsulting, LLC; Ian C. Barras

(57) ABSTRACT

A Hydraulic Manifold Control Assembly for use in connection with surface blowout preventers and diverter control systems. Said Hydraulic Manifold Control Assembly incorporates design elements and methods which reduce overall envelope dimensions, improving maintenance accessibility, thereby reducing overall installation and manufacturing time and ultimately contributing to a more robust, cost effective end-product. Said design elements and methods include: the use of intrinsically safe I/O modules and components; the employment of a removable valve assembly rack installation method; the use of a removable face plate for identification of flow control valves; the implementation of a digital automatic diverter sequence; the use of integrated manifold assemblies; and the integration of a wide-range function count.

20 Claims, 13 Drawing Sheets

Related U.S. Application Data

(60) Provisional application No. 62/253,518, filed on Nov. 10, 2015.

(51) Int. Cl.

| | |
|---|---|
| ***F15B 13/08*** | (2006.01) |
| ***E21B 33/06*** | (2006.01) |
| ***F15B 21/02*** | (2006.01) |
| *F15B 13/00* | (2006.01) |

(56) References Cited

U.S. PATENT DOCUMENTS

| | | | | | |
|---|---|---|---|---|---|
| 4,458,841 | A * | 7/1984 | Laakaniemi | F15B 13/081 | 236/49.4 |
| 5,703,345 | A * | 12/1997 | Gollner | F15B 21/02 | 235/375 |
| 6,032,742 | A * | 3/2000 | Tomlin | E21B 33/063 | 166/345 |
| 7,707,872 | B2 * | 5/2010 | Herbert | F15B 13/0814 | 73/49.7 |
| 9,625,049 | B2 * | 4/2017 | Starzmann | F16K 31/02 | |
| 2010/0038571 | A1 * | 2/2010 | Frank | B60T 8/327 | 251/129.15 |
| 2010/0181510 | A1 * | 7/2010 | Yoshimura | F15B 13/0825 | 251/129.01 |
| 2017/0328383 | A1 * | 11/2017 | Neef | F15B 13/0889 | |

* cited by examiner

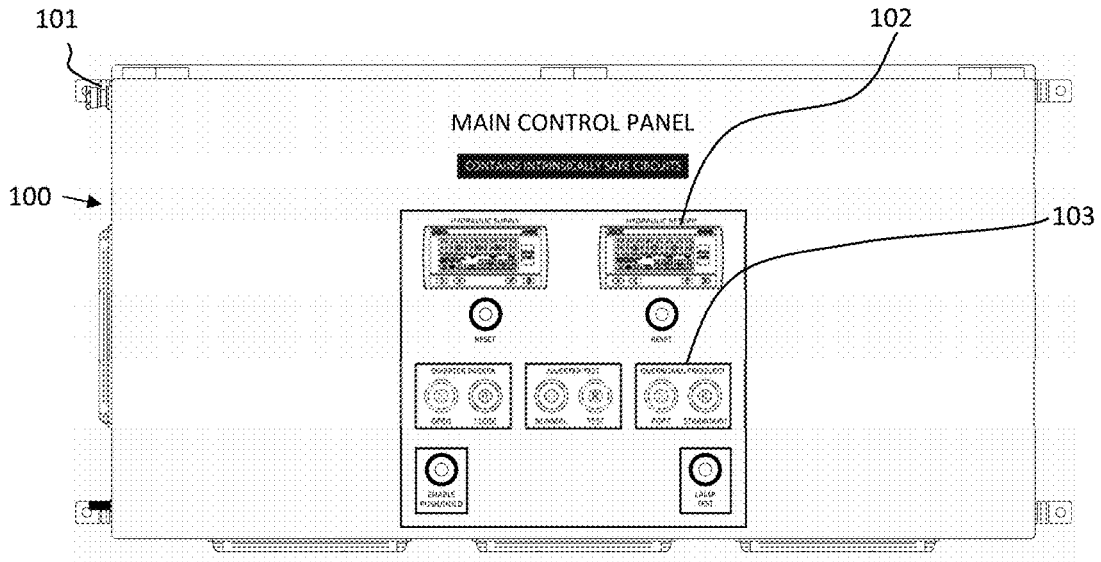
FIG. 1.1
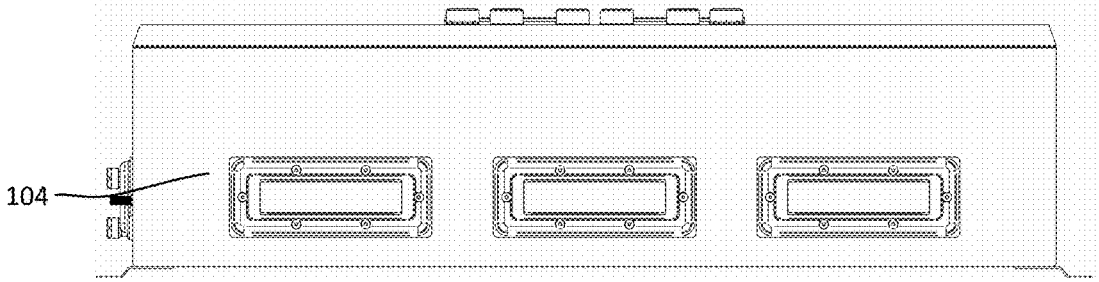
FIG. 1.2
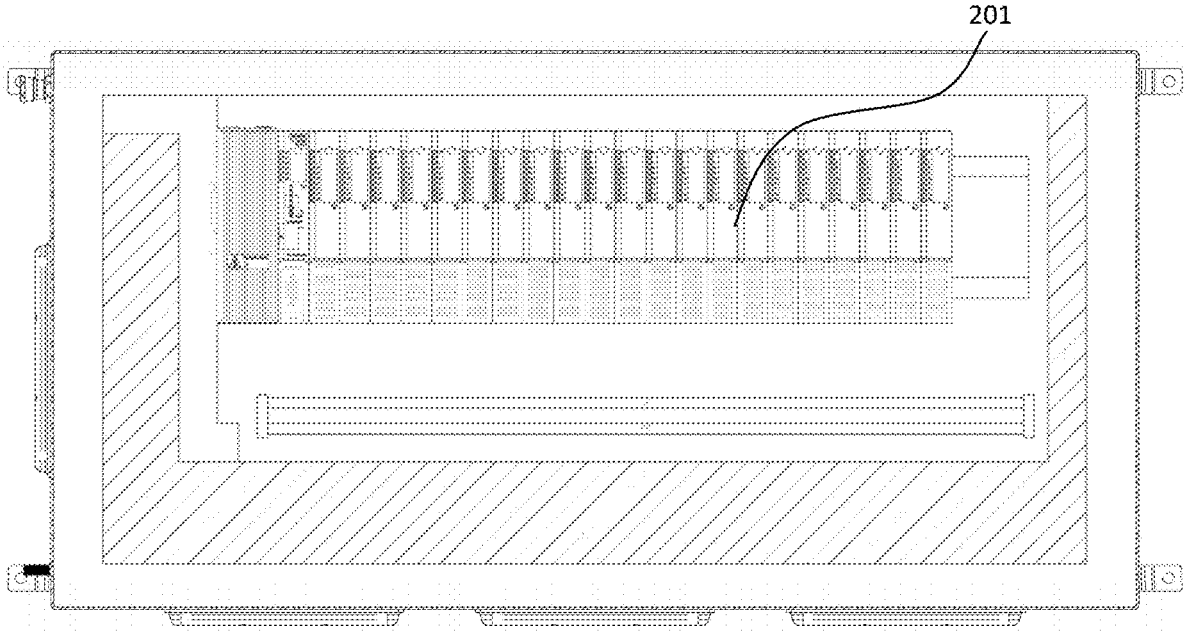
FIG. 2

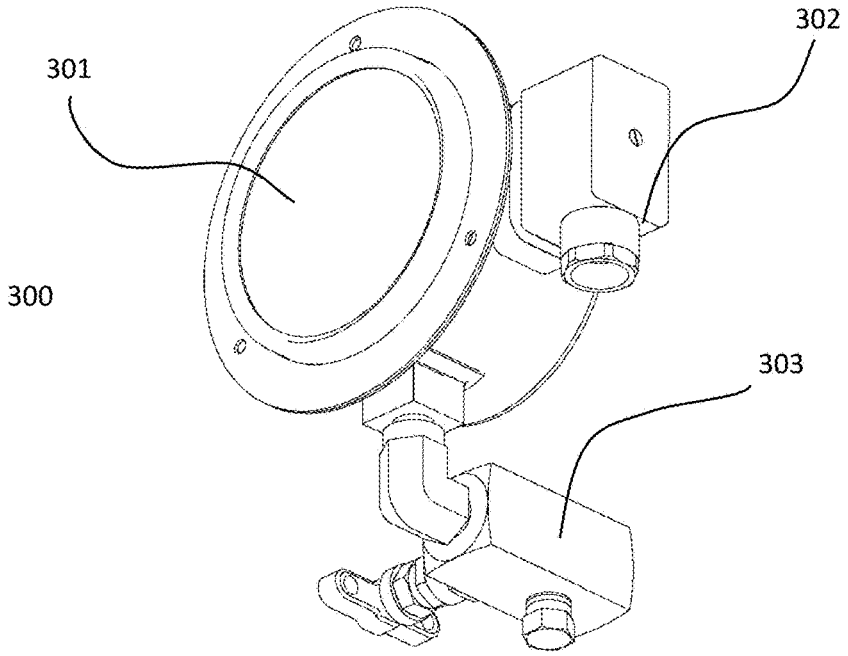
FIG. 3
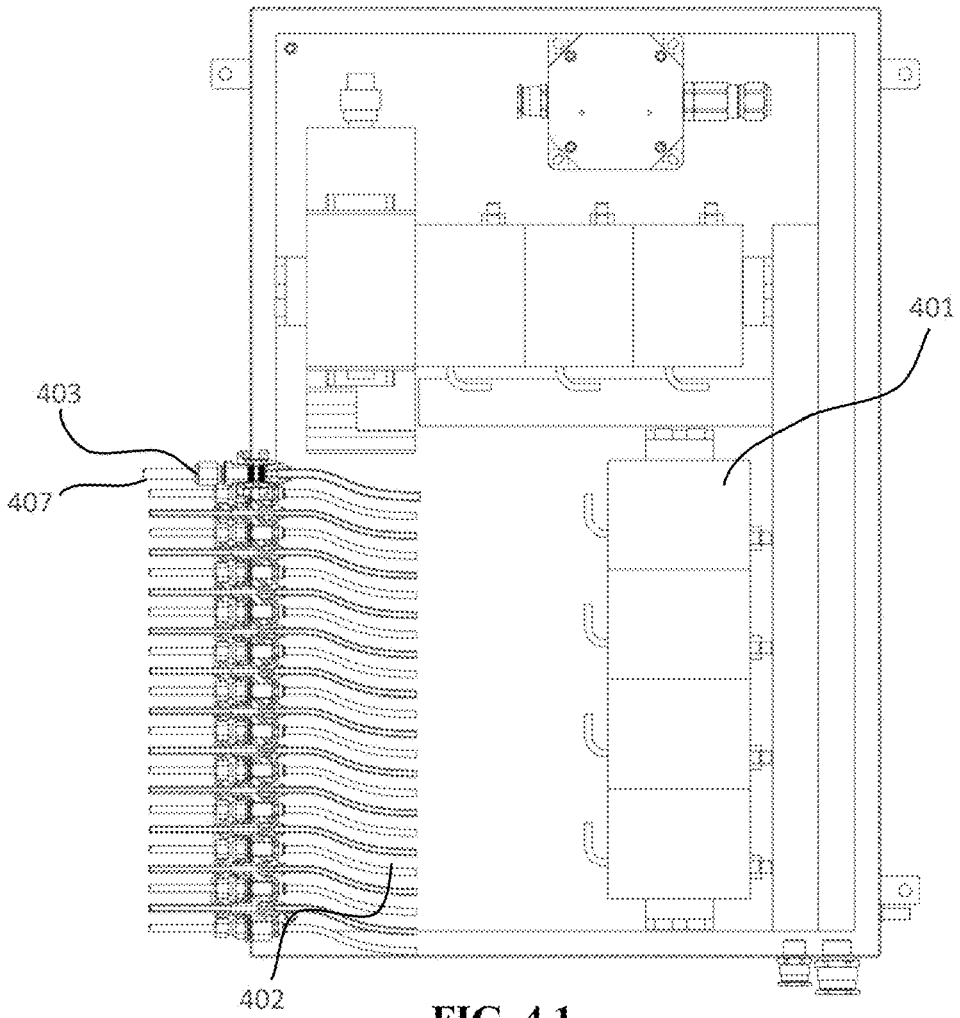
FIG. 4.1

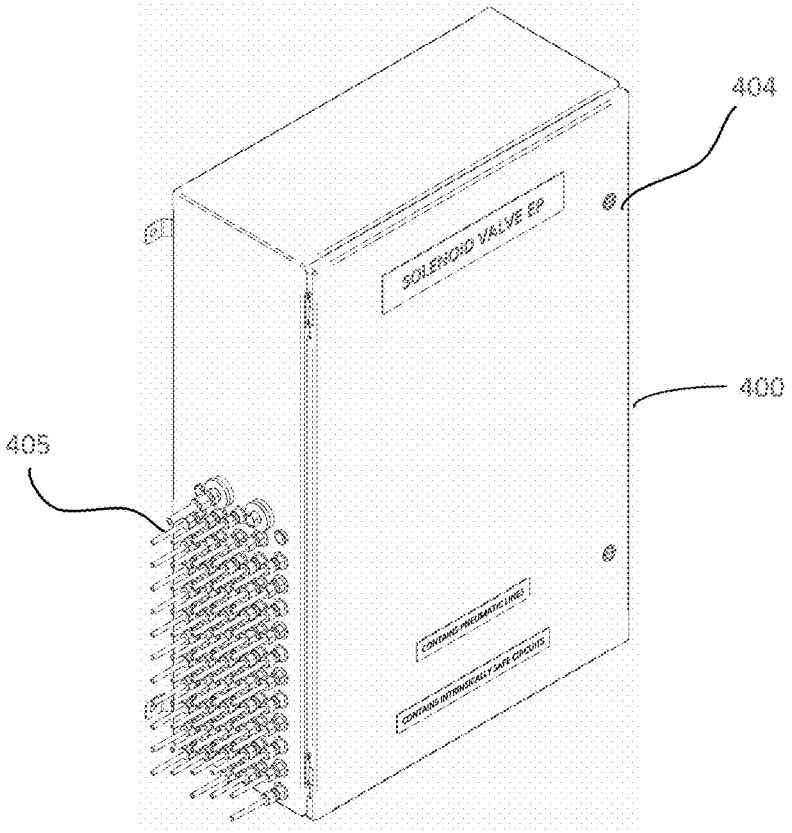
FIG. 4.2
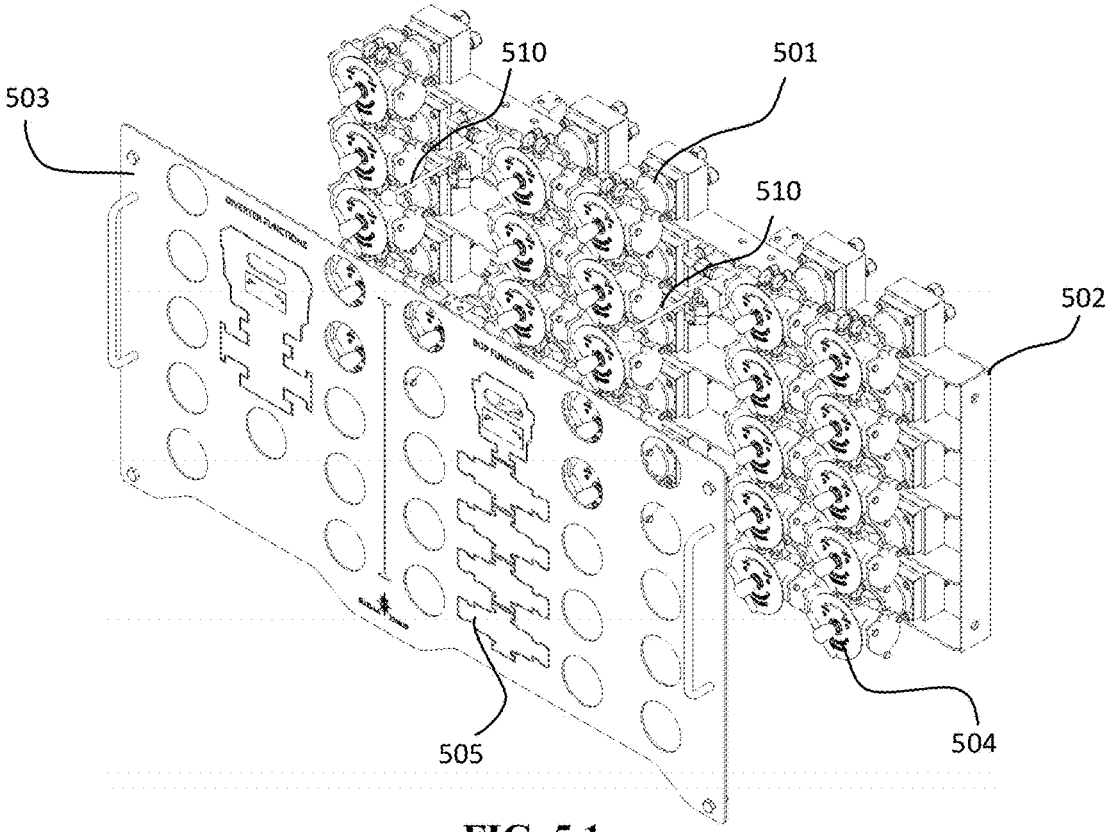
FIG. 5.1

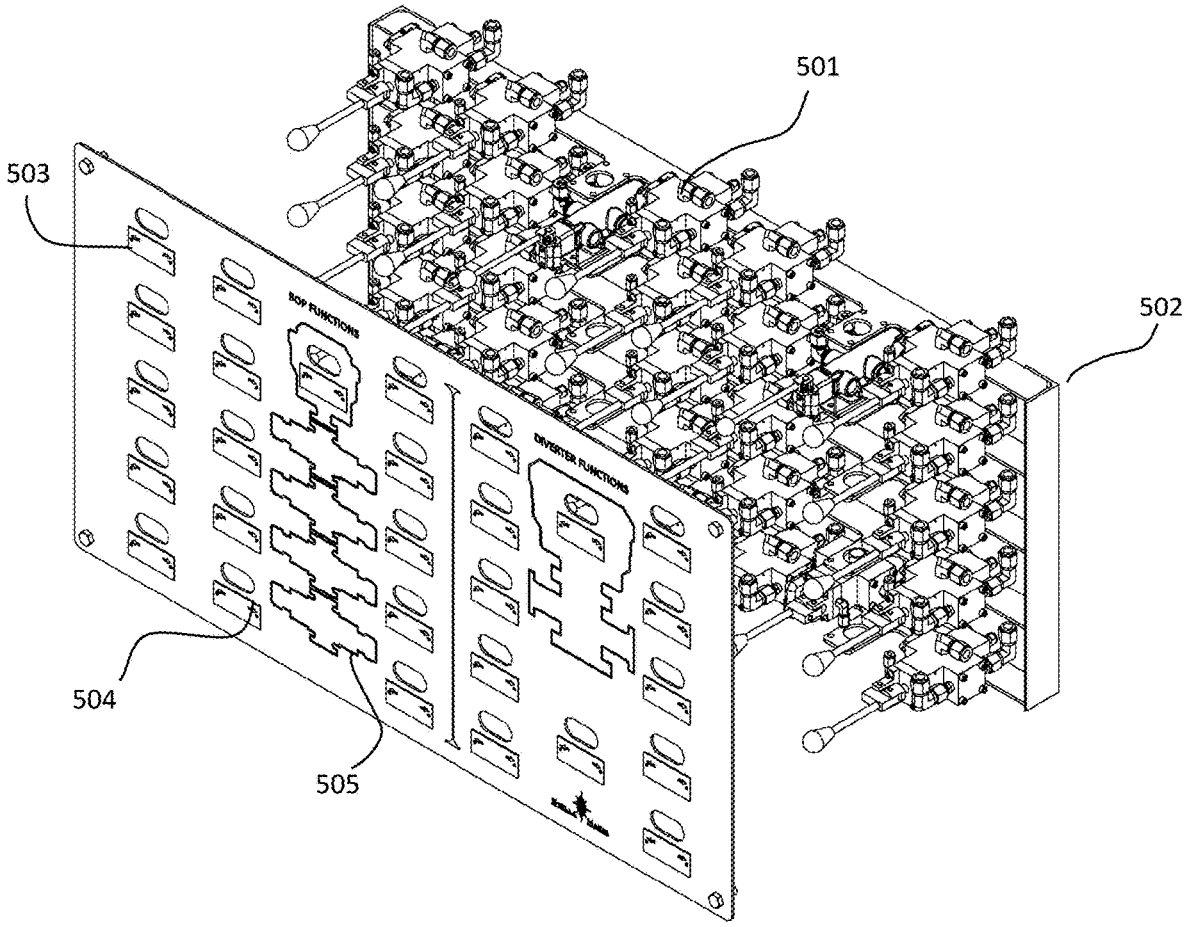
FIG. 5.2

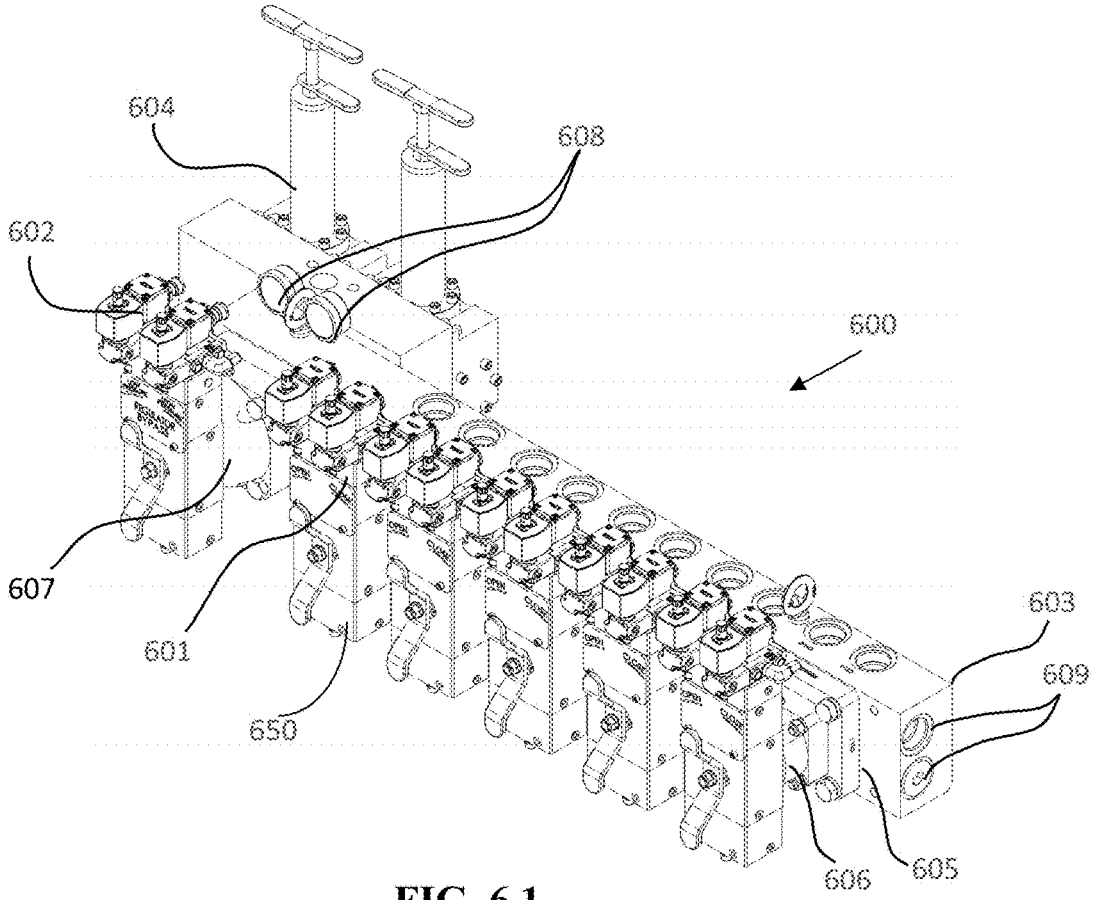
FIG. 6.1
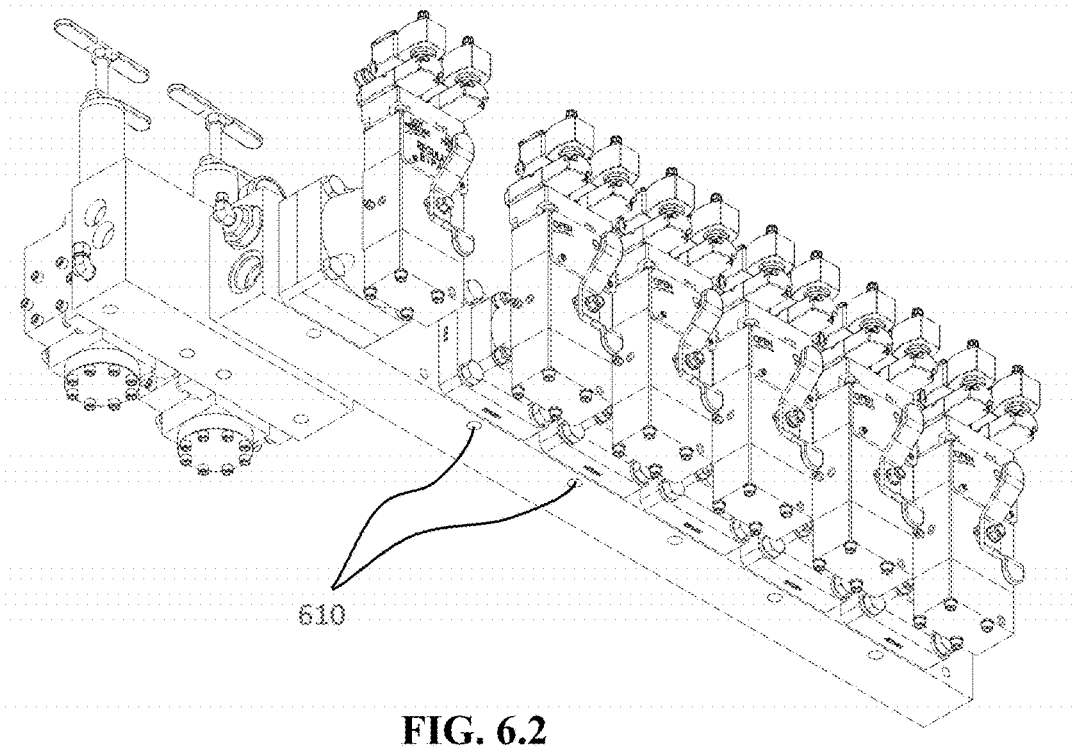
FIG. 6.2

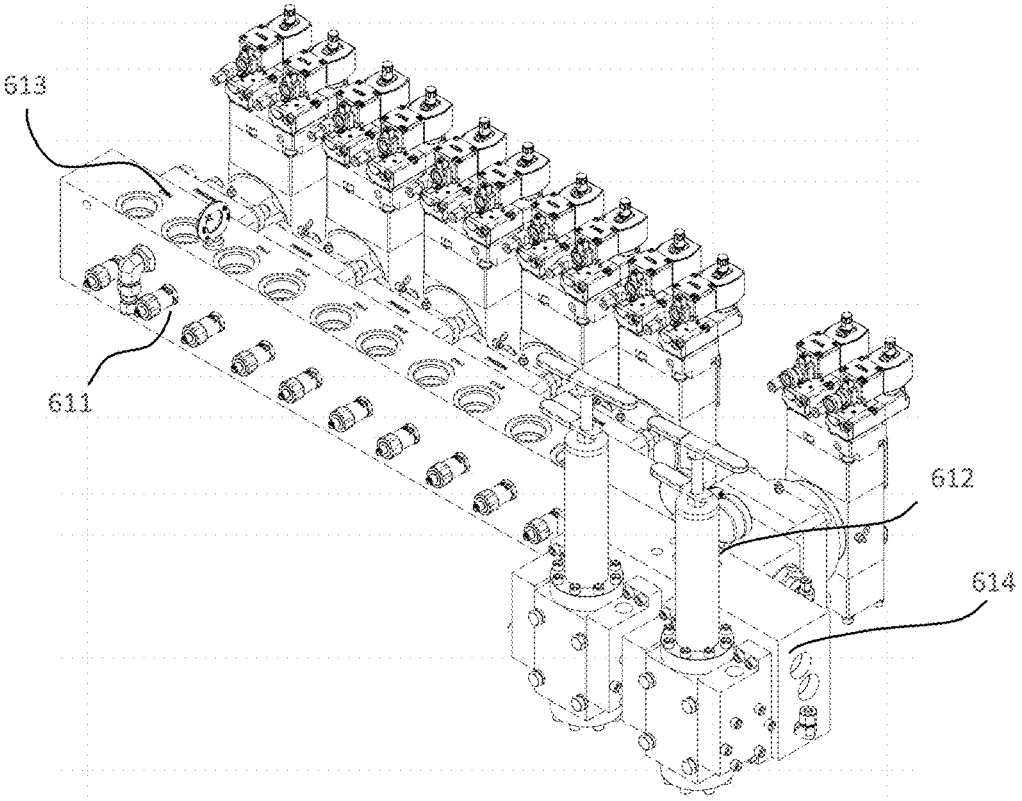
FIG. 6.3
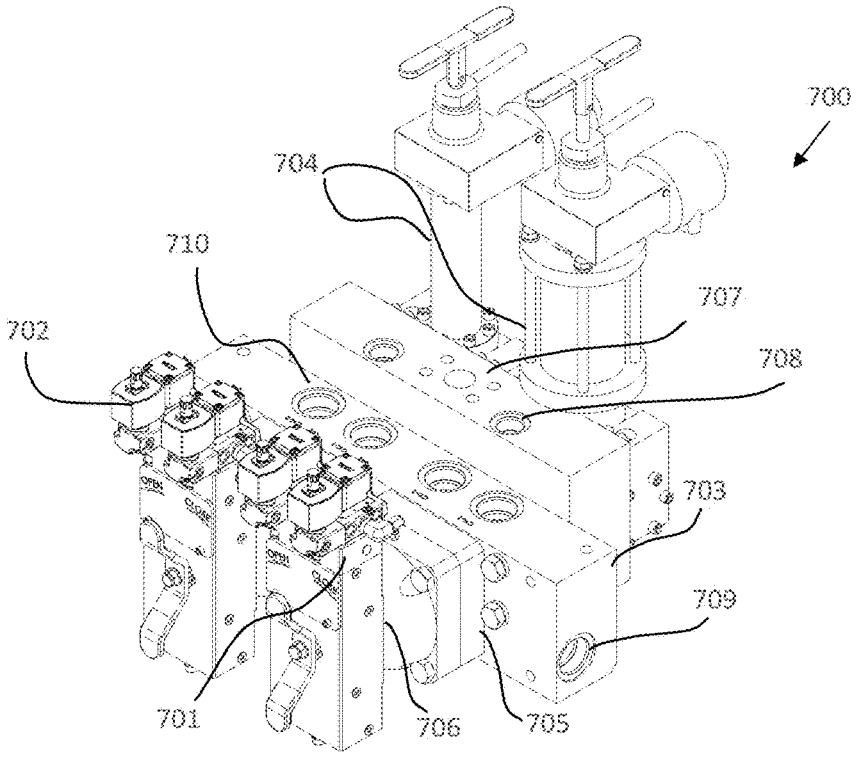
FIG. 7.1

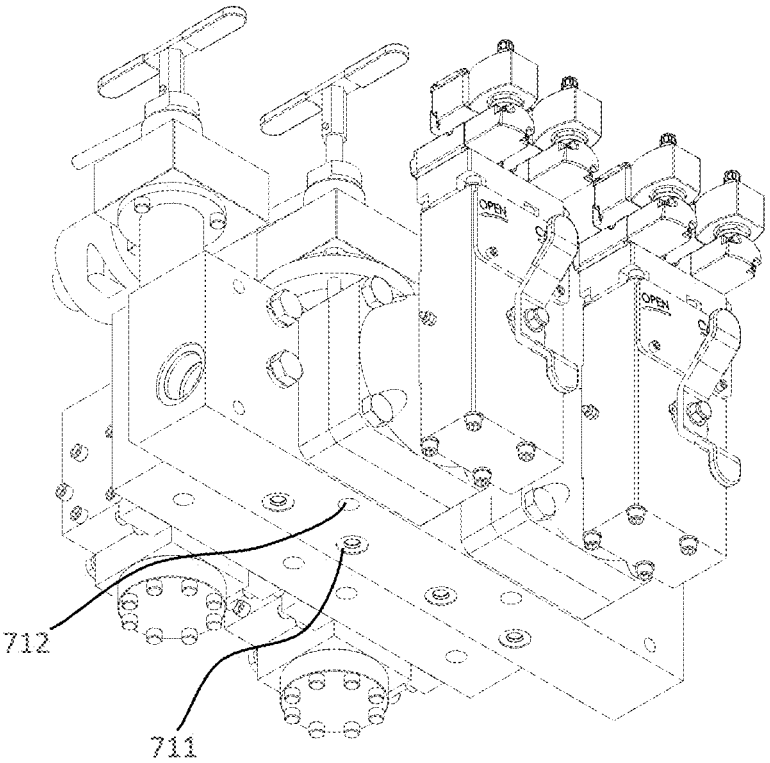
FIG. 7.2
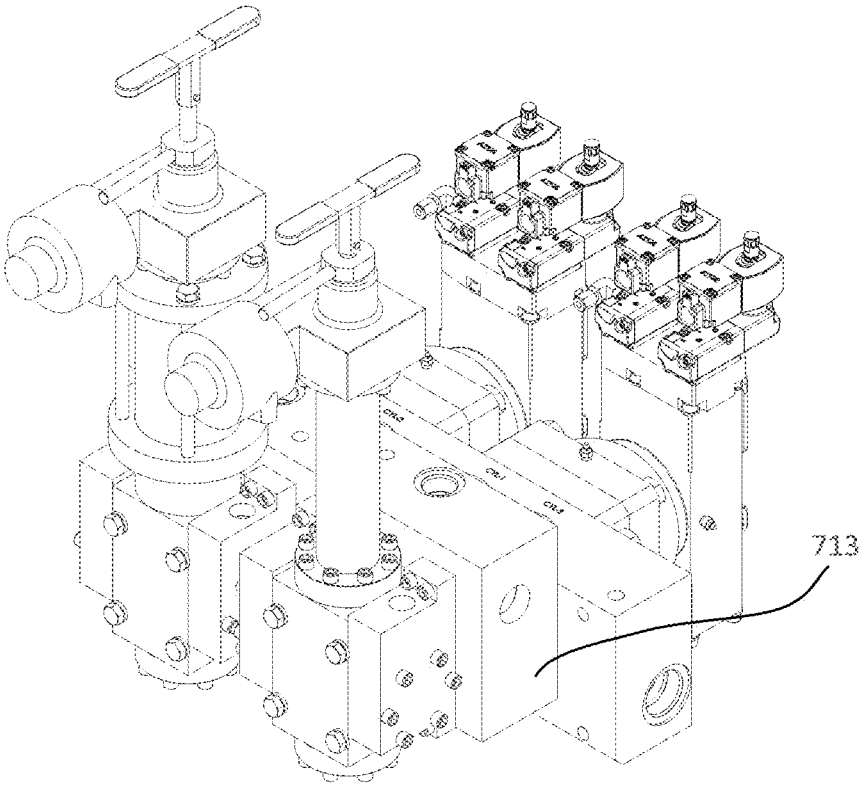
FIG. 7.3

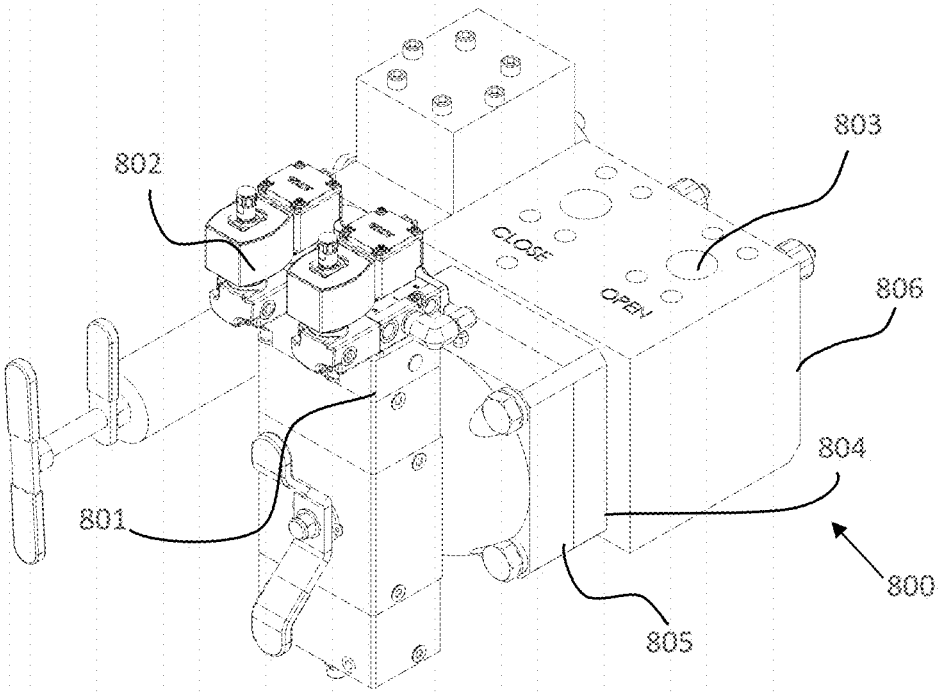
FIG. 8.1
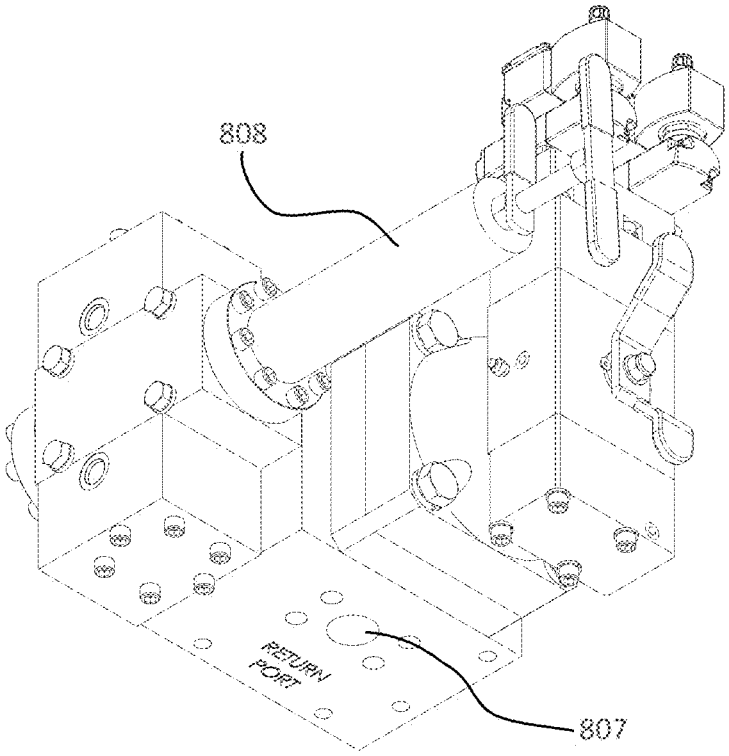
FIG. 8.2

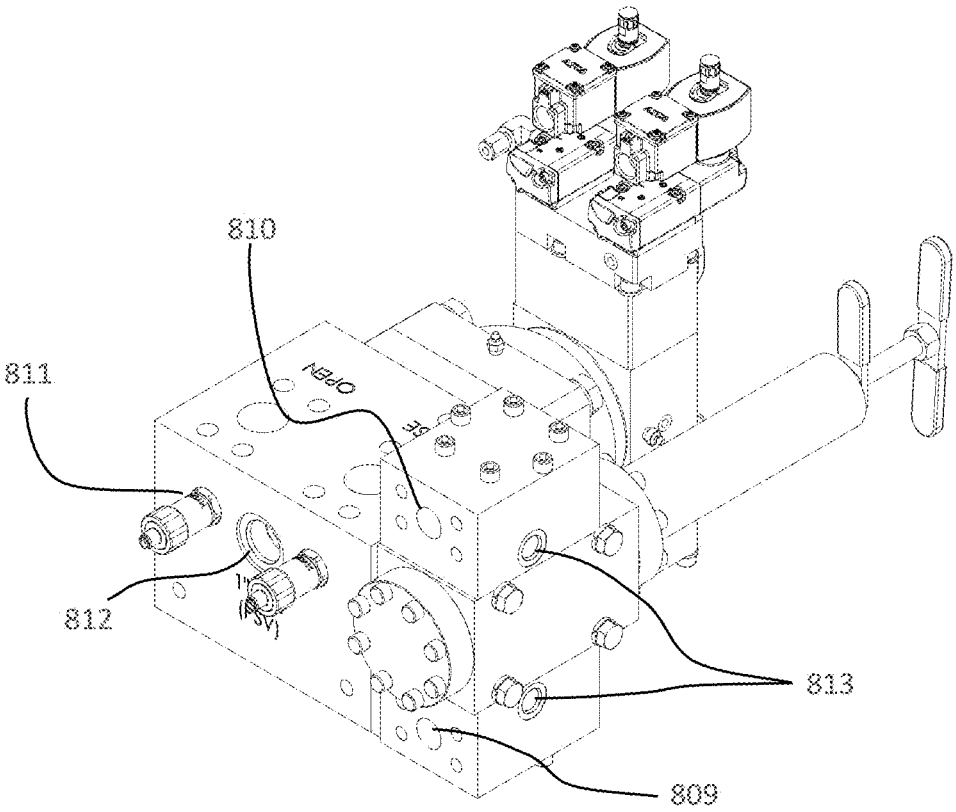
FIG. 8.3

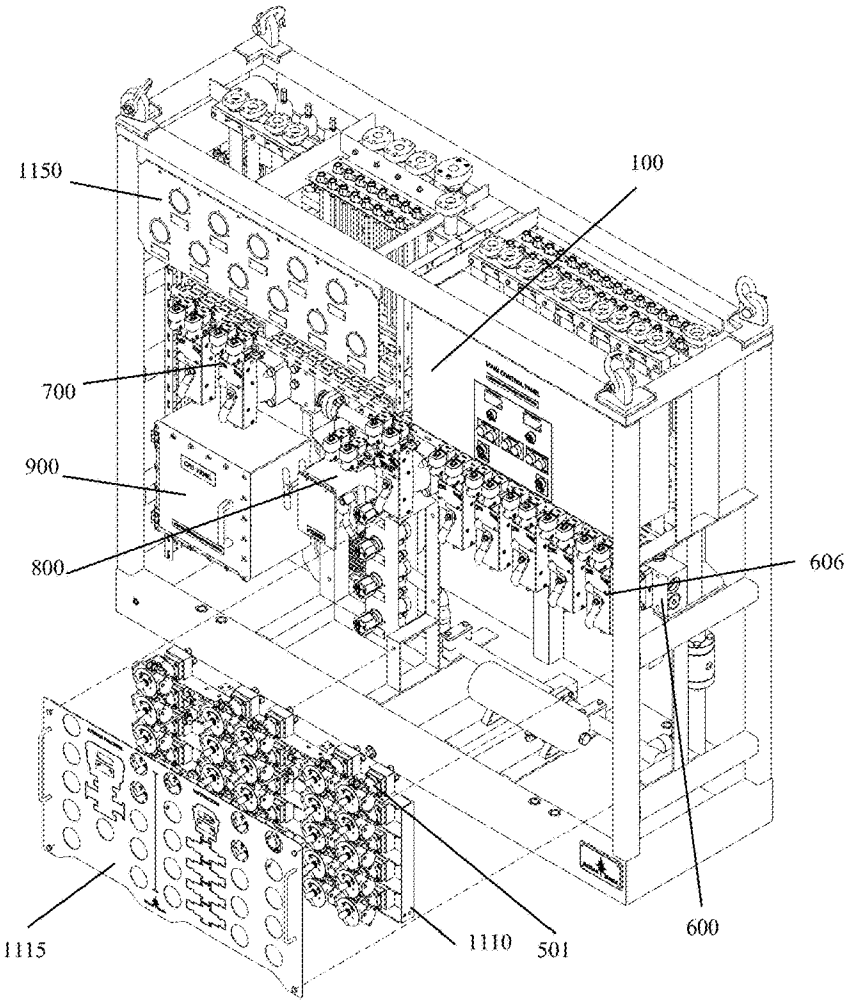
FIG. 11.2
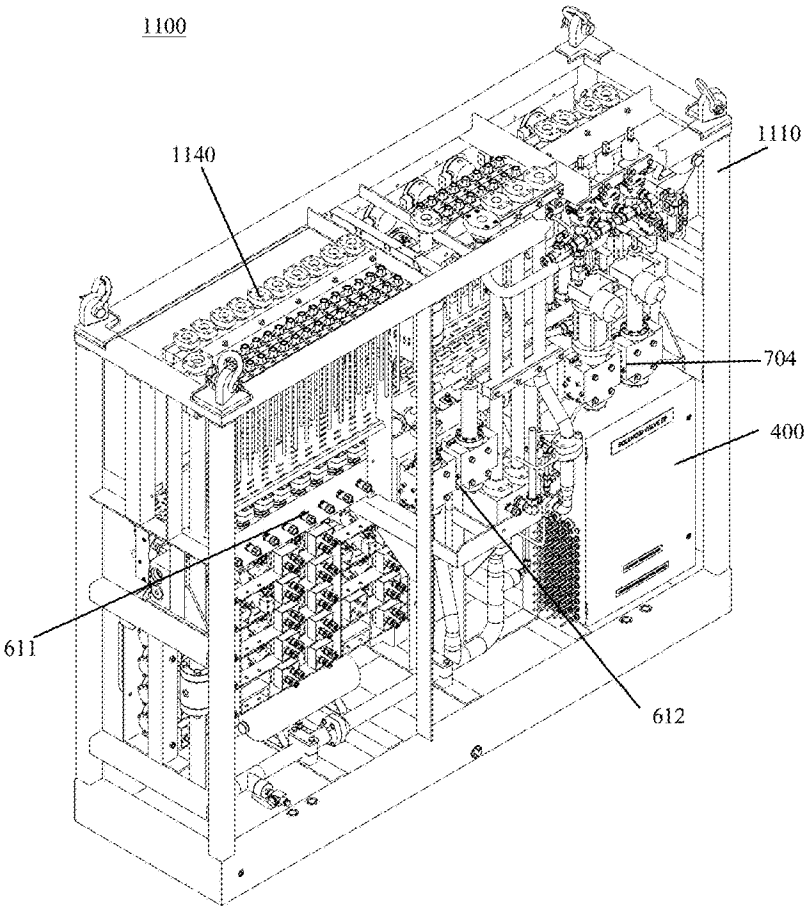
FIG. 11.1

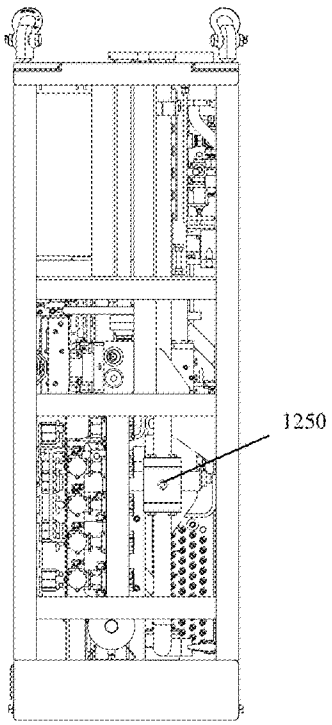
FIG. 12.3
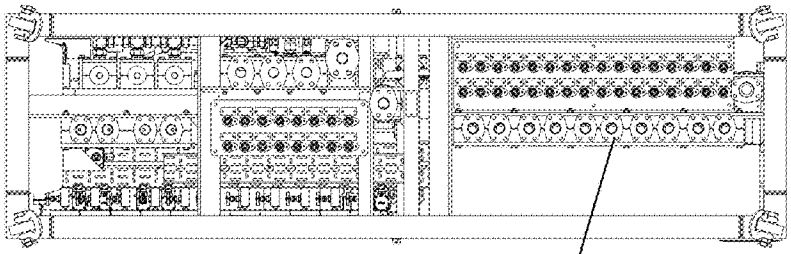
FIG. 12.4
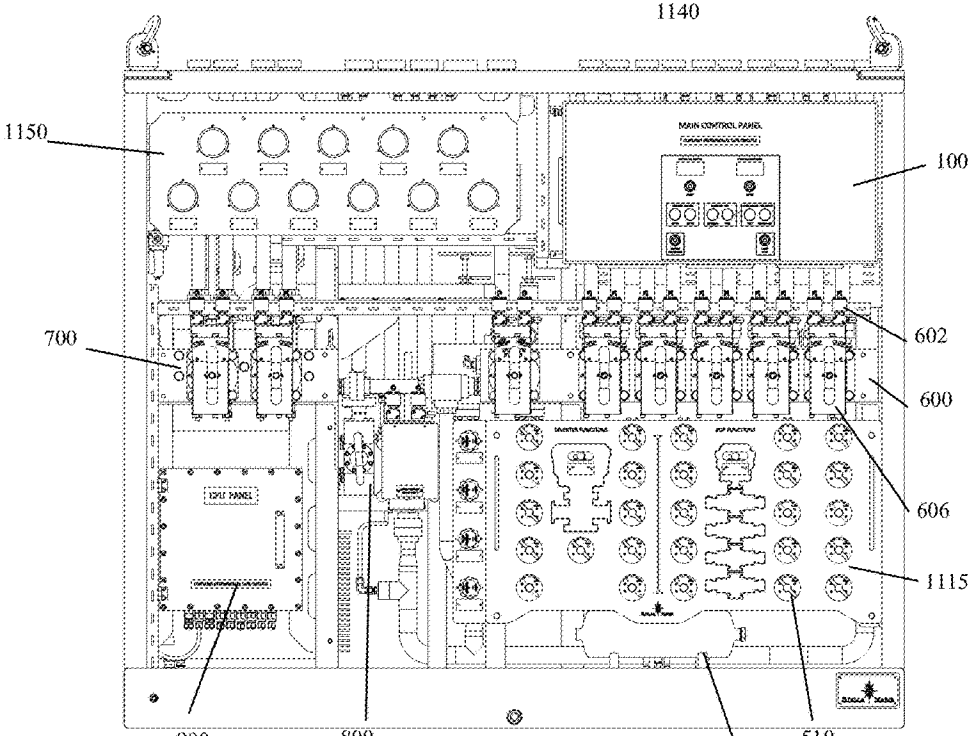
FIG. 12.2
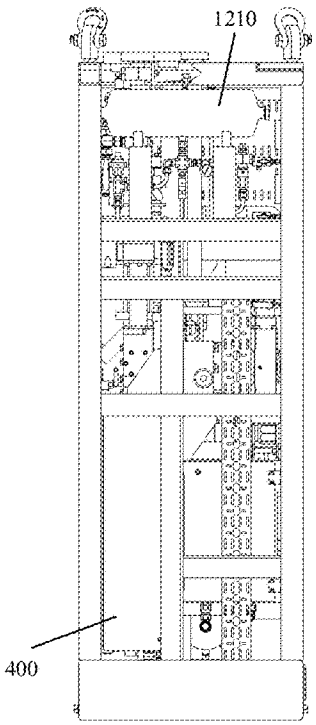
FIG. 12.1

HYDRAULIC MANIFOLD CONTROL ASSEMBLY

CROSS-REFERENCE TO RELATED APPLICATIONS

The present application is a divisional of, and claims priority from, co-pending U.S. patent application Ser. No. 15/348,934, filed Nov. 10, 2016, which in turn claims priority from U.S. Provisional Application No. 62/253,518, filed Nov. 10, 2015, and both of said prior-filed applications are incorporated herein by reference as if set forth in full below.

BACKGROUND OF THE INVENTION

I. Field

The invention relates to a control system designed for the operation of surface blowout preventer (BOP) and diverter systems. More specifically, the unique design elements and employment methods incorporated within the control system that offer an improvement over conventional methods and designs.

II. Background

Blowout preventers (BOP) and diverter control systems incorporate the use of flow control and electrical components to deliver hydraulic fluid to rams, valves, seals, and other types of equipment for their operation. These systems also provide means of monitoring key factors measured during well control operations.

The systems feature two different modes of operation: local manual and remote automated. Flow control valves are used for guidance of hydraulic fluid from the control system to the end-devices (rams, valves, seals and other types of equipment). For local manual operation, the flow control valves may be manually actuated. Alternately (for remote operation) remote stations are employed to initiate electric solenoid valves to control air flow to the air driven actuators of the same flow control valves.

Piping and tubing materials (system rated working pressure of 3000 PSI) are used for the interconnection of flow control components. In conventional BOP and diverter control systems, large manifolds are installed for the interconnection of common fluid supply and return ports of flow control valves for functions of high volume requirements.

Additionally, the methods used to construct the piping system associated with such control systems involve custom-designed piping and tubing runs specially designed for each individual project. These piping systems include welding of components by means of butt and/or socket welds. This welded piping system is further tested to ensure that the integrity of the welds satisfy all third-party requirements. Further, tubing lines are installed for the interconnection of flow control valves for functions of low volume requirements. These valves are normally permanently attached to a function plate or mounted on the unit's skid frame. Furthermore, tubing connections are guided to individual pressure reading devices (including gauges, electric switches and transmitters) for the purpose of sensing pressure at key points. All of these specialized piping and tubing runs can significantly increase the cost of installing a given BOP and diverter control system.

Conventional diverter control systems provide means of delivering automated sequences when operating a Diverter Packer. A series of diverter functions are automatically actuated upon operation of the diverter packer by implementing an air-based logic sequence with the use of shuttle valves, air timers, and air piloted valves. This air-based control system further increases the cost and complexity of conventional systems.

Due to the harsh environmental conditions presented in drilling areas, conventional surface blowout preventer (BOP) and diverter control systems are designed to safely operate in harsh hazardous locations. The safe operation of such control systems within hazardous environments contributes to the selection of hazardous area-rated electric components. Conventional control system designs include the use of flameproof equipment as a preferred method of protection (as seen in the oil and gas industry). This hardened equipment again increases the cost, and bulk, of conventional systems.

For the reasons mentioned above, there is a need for a compact BOP and diverter control system that eliminates the need for many of the bulky components associated with conventional control systems, while at the same time being capable of operating in an intrinsically safe manner given the hazardous conditions.

SUMMARY OF THE INVENTION

An embodiment of the present invention comprises a hydraulic manifold control assembly, which comprises: a frame, wherein said frame defines an outer perimeter; a processing unit; a control panel, comprising a push button and an indicator, wherein said control panel is in communication with said processing unit; a solenoid rack module comprising a solenoid, a valve, and a compressed air line, wherein said solenoid rack module is in communication with said processing unit, wherein said solenoid is operable to open or close said valve in response to receiving a signal, and wherein opening and closing of said valve controls a flow of compressed air in said compressed air line; a first integrated manifold assembly comprising: a first manifold, wherein said first manifold is operable to receive hydraulic fluid under a first pressure; and a first regulator attached to said first manifold, wherein said first regulator attached to said first manifold is operable to regulate a first available internal pressure of said hydraulic fluid within said first manifold; a flow control valve, wherein said flow control valve is mounted to said first manifold, wherein said flow control valve is connected to said solenoid rack module via said compressed air line, and wherein said flow control valve is operable to receive and redirect said hydraulic fluid from said manifold to a location exterior to said hydraulic manifold control assembly; a valve assembly rack, wherein said flow control valve is mounted to said valve assembly rack and wherein said valve assembly rack is configured to allow for access to said flow control valve from a front side of said frame; and, a removeable function plate, wherein said removeable function plate is attached to said valve assembly rack on said front side of said frame, and wherein said removeable function plate is operable to be removed from said valve assembly rack without first removing said flow control valve; wherein one or more of said control panel, said processing unit, said solenoid rack module, said first integrated manifold assembly, said flow control valve, said valve assembly rack, and said removeable function plate are mounted to said frame.

Another embodiment of the present invention is an integrated manifold assembly comprising a manifold body, comprising a plurality of manifold ports; a plurality of flow control valves, wherein each flow control valve of said plurality of flow control valves comprises: a valve actuator; mounting pads attached to said valve actuator; a plurality of solenoid valves attached to said mounting pads; and a lever; wherein each flow control valve of said plurality of said flow control valves is operable either by actuation of said lever or by actuation of at least one solenoid valve of said plurality of said solenoid valves; a first regulator; and, a second regulator; wherein said first regulator and said second regulator are mounted in parallel to said manifold body; and, wherein each flow control valve of said plurality of flow control valves is connected to one of said manifold ports.

BRIEF DESCRIPTION OF THE DRAWINGS

For a further understanding of the nature and objects of the present invention, reference should be had to the following description taken in conjunction with the accompanying drawings in which like parts are given like reference numerals.

FIG. 1.1 is an external assembly view illustrating the layout of the Main Control Panel (MCP).

FIG. 1.2 is an external assembly view illustrating the bottom of the Main Control Panel (MCP).

FIG. 2 is an internal assembly view of the Main Control Panel (MCP) illustrating the installation of intrinsically safe remote I/O modules housed within an enclosure. The enclosure's door is not shown for clarity.

FIG. 3 is an assembly view illustrating the layout of the pressure gauge/transmitter assemblies (intrinsically safe) coupled with a block-and-bleed valve. The layout also illustrates the pluggable connectors the device utilizes to interface with the system.

FIG. 4.1 is an internal assembly view of the Solenoid Valve EP Panel illustrating the installation of the self-contained solenoid rack modules within an ingress-protection rated enclosure. A vertical cross section is depicted for clarity.

FIG. 4.2 is an external assembly view of the Solenoid Valve EP Panel.

FIG. 5.1 is an assembly view illustrating the removable valve assembly rack and function plate. The schematic depicts how BOP and diverter function flow control valves are mounted to the valve assembly rack. Similarly, the assembly view provides a visual depiction of how the plate lines-up with the assembly rack.

FIG. 5.2 is an assembly view illustrating an alternative embodiment of the removable valve assembly rack and function plate.

FIG. 6.1 is an assembly view illustrating an integrated manifold assembly (BOP Manifold). The schematic shows a front-top view of the integrated manifold assembly for clarity.

FIG. 6.2 is an assembly view illustrating an integrated manifold assembly (BOP Manifold). The schematic shows a front-bottom view of the integrated manifold assembly for clarity.

FIG. 6.3 is an assembly view illustrating an integrated manifold assembly (BOP Manifold). The schematic shows a rear-top view of the integrated manifold assembly for clarity.

FIG. 7.1 is an assembly view illustrating an integrated manifold assembly (Diverter/Annular Integrated Manifold). The schematic shows a front-top view of the integrated manifold assembly for clarity.

FIG. 7.2 is an assembly view illustrating an integrated manifold assembly (Diverter/Annular Integrated Manifold). The schematic shows a front-bottom view of the integrated manifold assembly for clarity.

FIG. 7.3 is an assembly view illustrating an integrated manifold assembly (Diverter/Annular Integrated Manifold). The schematic shows a rear-top view of the integrated manifold assembly for clarity.

FIG. 8.1 is an assembly view illustrating an integrated manifold assembly (Shear Ram). The schematic shows a front-top view of the integrated manifold assembly for clarity.

FIG. 8.2 is an assembly view illustrating an integrated manifold assembly (Shear Ram). The schematic shows a front-bottom view of the integrated manifold assembly for clarity.

FIG. 8.3 is an assembly view illustrating an integrated manifold assembly (Shear Ram). The schematic shows a rear-top view of the integrated manifold assembly for clarity.

FIGS. 11.1 and 11.2 show isometric rear and front views, respectively, of the Hydraulic Manifold Control Assembly.

FIGS. 12.1, 12.2, 12.3, and 12.4 show assembly views of the Hydraulic Manifold Control Assembly from the left, front, right, and top, respectively.

Figure 9:
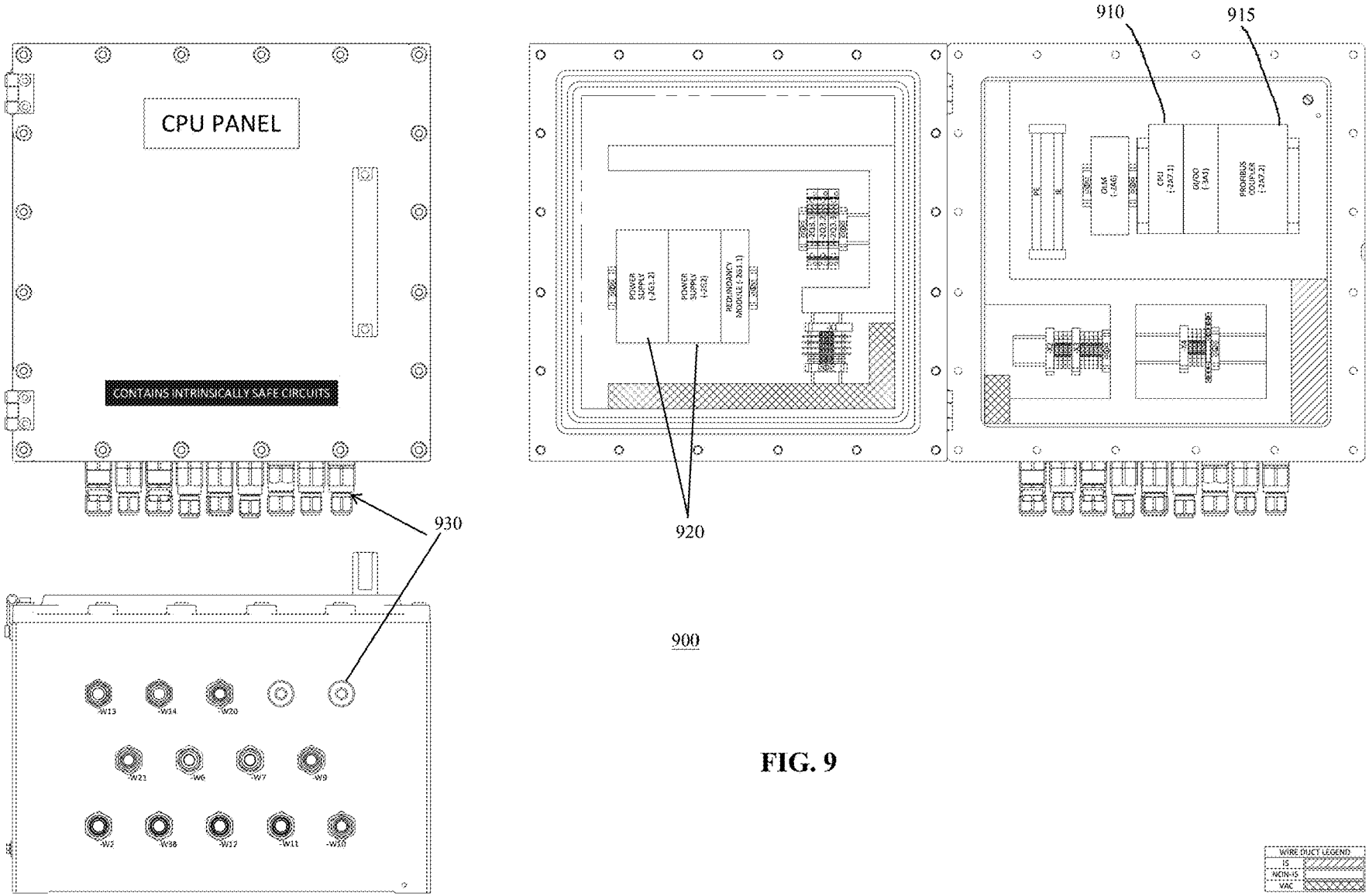
FIG. 9 provides two external assembly views, and one internal assembly view, of the CPU panel illustrating the installation of a processing unit, along with power supply modules and communications modules.

The images in the drawings are simplified for illustrative purposes and are not depicted to scale. Within the descriptions of the figures, similar elements are provided similar names and reference numerals as those of the previous figure(s). Where a later figure utilizes the same element or a similar element in a different context or with different functionality, the element is provided a different leading numeral representative of the figure number (e.g., 1*xx* for FIGS. 1 and 2*xx* for FIG. 2). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

The word "exemplary" is used herein to mean "serving as an example, instance, or illustration." Any configuration or design described herein as "exemplary" is not necessarily to be construed as preferred or advantageous over other configurations or designs.

The invention focuses on different unique design elements and employment methods incorporated within the surface blowout preventer (BOP) and diverter control system design (also referred to herein as the Hydraulic Manifold Control Assembly). These design elements and methods contribute to an improved design by reducing overall envelope dimensions, improving maintenance accessibility, and reducing overall installation and manufacturing time, and ultimately contributing to a more robust, cost effective end-product. The design elements and methods implemented for an improved design include: the use of intrinsically safe I/O modules and components; the employment of a removable valve assembly rack installation method; the use of a removable face plate for identification of flow control valves; the implementation of a digital automatic diverter sequence; the use of integrated manifold assemblies; and the integration of a wide-range function count.

The invention features the use of intrinsically safe remote I/O modules for the operation of intrinsically safe components, housed in an IP rated enclosure or Main Control Panel 100 as shown in FIGS. 1.1 and 1.2. In a conventional control system design, intrinsically safe barriers are housed in a flameproof enclosure to ensure compliance with all applicable installation requirements of the particular hazardous location. Due to the nature of the method of protection, and the area in which the equipment will be operated, the use of flameproof equipment normally necessitates the selection of large costly enclosures and field-mounted electrical end-devices. By contrast, main control panel 100 houses intrinsically safe remote I/O modules for the operation of intrinsically safe components. Similarly, the panel 100 includes intrinsically safe flow totalizers and pushbutton/lamp indicators used for local monitoring of Hydraulic Fluid Supply/Return flow and operation of Diverter Packer, Diverter Test, and Overboard Preselect.

Similarly, the use of intrinsically safe remote I/O modules allows for the elimination of intrinsically safe barriers as used in a conventional system design. FIG. 2 is an interior view of Main Control Panel 100, which shows that the use of intrinsically safe remote I/O modules 201 in a more compact enclosure 101. Said enclosure (or Main Control Panel) 101 also houses intrinsically safe flow totalizers 102 and intrinsically safe pushbutton/lamp indicators 103 used for local monitoring of Hydraulic Fluid Supply/Return flow and operation of BOP and Diverter mode functions.

Next, the use of intrinsically safe electrical components (as a preferred method of protection) eliminates the need of armored cable and potted cable glanding (as used in a conventional system design). Alternatively, the invention features the use of unarmored cable and a flexible sealing system 104 as shown in FIG. 1.2 (which shows a bottom view of enclosure 101), that replaces the use of cable glands (as used in a conventional system design), where each flexible sealing system 104 comprises, in an exemplary embodiment, a Roxtex® CF 16 frame. The flexible sealing system 104 allows for multiple cable entries to take place in a significantly smaller layout when compared to a conventional system design setup (where each cable would enter enclosure 101 via its own glanding). The ability to incorporate multiple cable entries within a small layout allows for ease of installation of all surrounding equipment. Furthermore, the use of intrinsically safe electrical components allows for all end-devices to interface with the system by utilizing pluggable/removable connections (one example as depicted in 302). Exemplary intrinsically safe electrical components used within the invention include: pressure switches, solenoid valves, pressure gauge/transducer assemblies and flow meter pickoffs. The pressure gauge/transducer assembly 303 shown in FIG. 3 integrate both a pressure gauge and a transducer (internal) 301 in one unit. The use of such devices contributes to the elimination of multiple tubing runs (to both pressure gauge and transducer) as would normally be found in a conventional system design. When coupled with a block-and-bleed valve 303, the pressure gauge/transducer assembly 301 enables the invention to grant an ease of maintenance. The use of block-and-bleed valves 303 allow users to easily replace the pressure gauge/transducer assemblies 301 without shutting down the system.

In addition to the previously mentioned components, the invention includes the use of self-contained intrinsically safe solenoid rack modules 401, as shown in FIG. 4.1 (where said modules 401 are housed within solenoid valve EP panel 400). In a conventional system, individual flame-proof rated solenoid valves are attached to a unit's skid frame. Individual tubing lines are then guided from the solenoid valves to air-piloted flow control valves. This method involves the use of flameproof-rated solenoid modules which require individual armor/braided cable runs to take place in order to interconnect the devices with the I/O modules. In such a design, all I/O modules and related electrical equipment are typically housed within flameproof enclosures to maintain a level of protection while present in hazardous environments. In contrast, the use of self-contained solenoid rack modules 401 eliminates the need of individual armor/braided cable runs as required in a conventional design. The self-contained solenoid racks 401 are further enclosed within an ingress-protection (IP) rated enclosure 404, as shown in FIG. 4.2, to safely protect the equipment from external ingress of dust and water particles (the enclosure assembly is also referred as Solenoid Valve EP). The invention features an IP rated enclosure with individual penetrations that allow the setup to maintain an ingress-rating while providing means of easily installing bulkhead unions 405. This installation method allows the individual solenoid valve ports to interconnect with the respective bulkhead connection port via flexible tubing 402 (inside the enclosure). The use of flexible tubing contributes to an easy installation and manufacturing time improvement. Individual tubing connections 403 are then established to respective bulkhead connection ports on the outer side of the IP rated enclosure, delivering air pressure to respective air-piloted flow control valves (see, e.g., valves 501) via tubing 407 (tubing also referred to herein as "compressed air line").

Overall, the invention features a space-efficient ergonomic skid design and an ease of maintenance, delivered by incorporating intrinsically safe modules and electrical components.

The invention includes a removable valve assembly rack 502 capable of being assembled as shown in FIGS. 5.1 and 5.2 (where FIG. 5.2 shows an alternative embodiment of said removable vale assembly rack). Conventionally, flow control valves are installed on a function plate (i.e., a plate that is assembled while fixed to the unit's skid). Upon completing the mounting of all control valves to the function plate, tubing interconnections are routed as needed. This installation method diminishes the ability to deploy multiple connections at a time. Similarly, such method limits the ability to service individual valves (when needed) without tampering with other disassociated connections. Conversely, the removable valve assembly rack 502 provides means of installing and interconnecting individual flow control valves 501 off the unit's skid. Similarly, the use of an assembly rack 502 grants the ability to install and interconnect multiple valves 501 at a time. As a result, the invention's installation method grants the ability to easily service individual valves. Upon completion, the assembly rack 502 can be easily attached to the skid frame. Lastly, a removable function plate 503 is placed in front of the assembly rack, covering all interconnection lines. The removable plate 503 can be modified to satisfy the project's specific requirements, contrary to the function plates used in a conventional design. Each flow control valve 501 includes an attachable name tag 504 to indicate the flow control valve function's name for identification. The use of a removable plate contributes for an ease of maintenance, when needed. The flow control valves 501 are physically arranged as a graphic representation of the project's BOP function stack and Diverter valves (an exemplary graphical layout 505 is depicted on the removable plate), where the BOP functions may be manually operated via one or more of actuating levers 510. The removable valve assembly is designed to allow for the installation of flow control valves 501 of size ¼" or ½" and of different tubing dimensions as applicable (usually either ¼" or ½" NPT).

The invention also features the implementation of a digital automatic diverter sequence. In a conventional control system design, the automatic diverter sequence is carried out via pneumatic logic by the use of shuttle valves, air timers, and air piloted valves. By contrast, in the present invention, a digital automatic diverter sequence is accomplished via PLC logic (software implementation); located at the CPU Panel 900 (shown in detail in FIG. 9), and the use of electric solenoid valves. The diverter sequence is commenced upon actuation of the Diverter Packer Close function accomplished locally via the Main Control Panel or remotely via the Remote Control Panel(s) (not shown, where said Remote Control Panel(s) comprise control panel(s) pre-programmed to operate BOP and Diverter functions; and monitor pressures, flow count, and alarms). Incorporating a digital automatic diverter sequence allows for the invention to eliminate the use of unnecessary pneumatic-oriented components (as used in a conventional design); which contributes to the reduction of overall skid dimensions and improvement of the system's overall reliability and repeatability. Improvement of overall reliability is obtained by eliminating potential failure contributed by the otherwise use of mechanical components. Similarly, good repeatability is obtained by eliminating mechanical components susceptible to un-controllable factors such as wet pneumatic pressure source.

Figure 10:
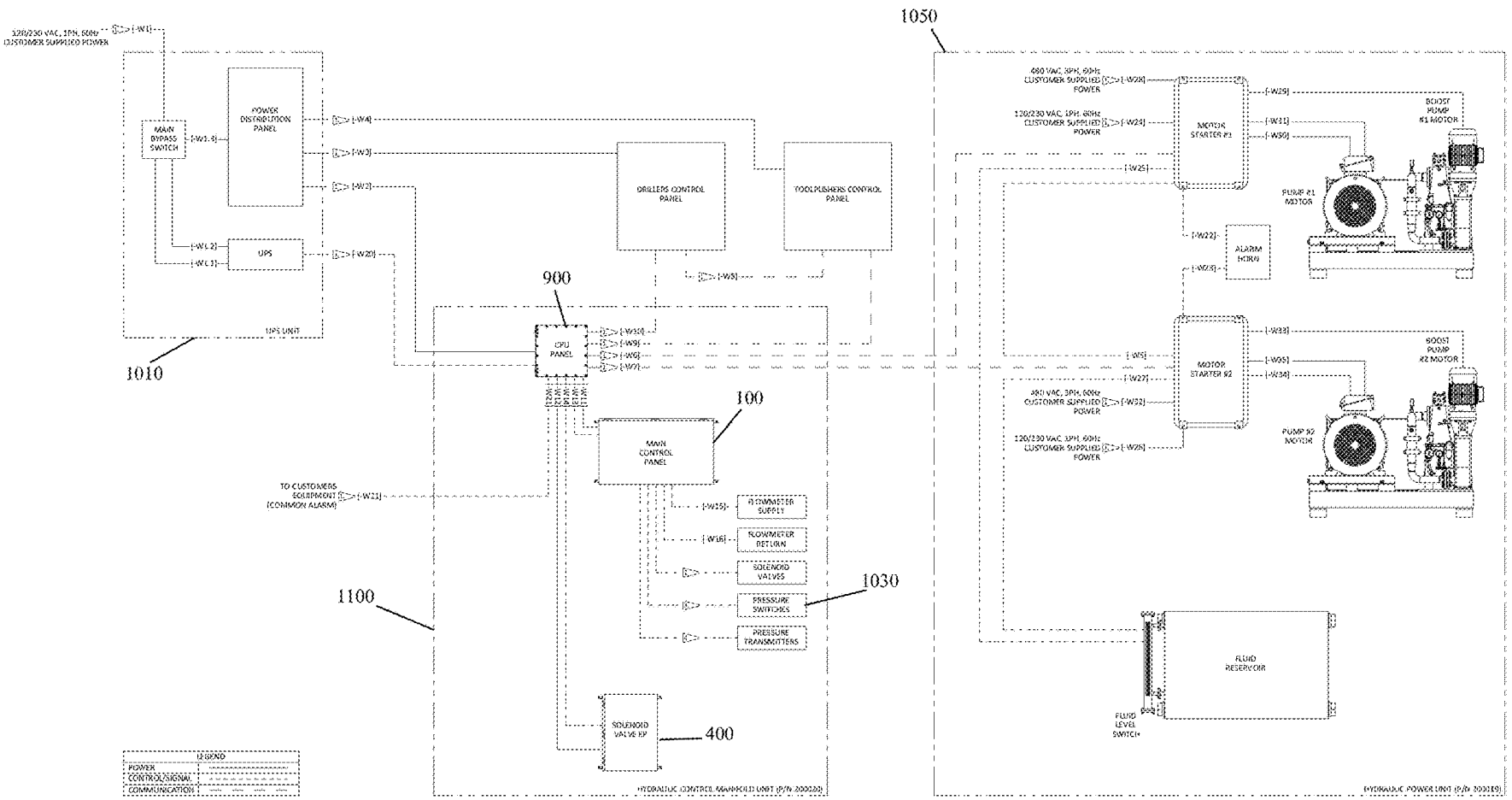
FIG. 10 is an electrical connection diagram of the Hydraulic Manifold Control Assembly together with related exterior power and hydraulic supply systems.

CPU Panel 900 (FIG. 9) comprises an enclosure housing a processing unit (in an exemplary embodiment, a programmable logic controller (PLC)) 910, intrinsically safe communications module 915, and power supplies 920. Signals from various sensors and actuators, including solenoid valves 602, pressure switches 812, flowmeter pickoffs 1250, and pressure transmitters (not shown), as well as signals from Main Control Panel 100 and solenoid valve EP panel 400, are brought into CPU Panel 900 via cabling via cable ports 930. PLC 910 controls functions of all control panels, all solenoids, and hydraulic power unit 1050. FIG. 10 shows an electrical connection diagram of Hydraulic Manifold Control Assembly 1100, including a layout of how CPU Panel 900 is interconnected with various devices. Specifically, UPS unit 1010 is connected to Hydraulic Manifold Control Assembly 1100 (as well as certain exterior control panels). CPU panel 900 is also connected to Main Control Panel 100, solenoid valve EP panel 400, various sensors and actuators included within Hydraulic Manifold Control Assembly 1100, and the motor starters of hydraulic power unit 1050 such that CPU panel 900 controls the operation of hydraulic power unit 1050 in response to certain pressure sensor inputs (as hydraulic power unit 1050 provides the hydraulic pressure necessary to operate Hydraulic Manifold Control Assembly 1100).

Another method followed for an improved control system design is the use of integrated manifold assemblies as depicted in FIGS. 6.1, 6.2, 6.3; FIGS. 7.1, 7.2, 7.3; and FIGS. 8.1, 8.2, 8.3. The integrated manifold assemblies include: flow control selector valves, valve actuators, and hydraulic regulators. Conventionally, piping systems with a rated working pressure of 3000 PSI are used to interconnect flow components. The use of piping systems requires welding operations (typically socket welds) to successfully complete the installation. Adversely, welded piping structures are further tested to confirm all welds satisfy third-party requirements. In contrast, the use of integrated manifold assemblies enables the invention to create an improved piping system design by significantly reducing piping bends and elbows, and generating a consistent flow path design. The piping design features strategic port arrangement to enable all necessary piping to be prefabricated and staged for manufacturing. The use of integrated manifold assemblies enables the piping design to account for a "worse-case" function count; enabling identical flow paths and generating a uniform design applicable to use from project to project. The integrated manifold assemblies (assemblies 600, 700, and 800) allow for direct mounting and interconnection of components such as flow control valves, valve actuators, hydraulic regulators, and pressure switches; reducing the need of individual tubing runs typically used to interconnect such components. Solenoid valves are further installed on the valve actuators to enable remote operation of such. In addition, individual inspection ports are included on the manifolds to allow for an ease of maintenance in case of fluid leakage. In short, incorporating the use of integrated manifold assemblies in the invention contribute to an improved design by reducing the number of piping bends and improving overall flow path consistency; factors that contribute to reducing overall envelope dimensions, enabling ease of manufacturing, reducing overall installation and manufacturing time, and improving maintenance accessibility.

Integrated manifold assembly 600 allows for the interconnection of components used for the operation of BOP ram functions. The integrated manifold assembly 600 features Namur mounting pads 601 located on each 4-way valve actuator 650; which facilitate the mounting of solenoid valves 602. Integrated manifold assembly 600 incorporates an internally ported adapter which allows for two KR-140 regulators 604 to mate in parallel when installed. In addition, the manifold assembly 600 includes two ¼" NPT connection ports 608 used for the connection of sensing lines of pressure regulators 604. Individual ½" NPT inspection ports 610 are included at the manifold to allow for an ease of maintenance in case of fluid leakage. Adapter subplate assemblies 614 are utilized to facilitate the mating of multiple regulators 604 in parallel with a 1-W Code62 common supply port 612. Similarly, adapter plates 605 are used to allow SVX-100 or SVX-150 valves 606 to mate with the manifold 603. Internal porting allows for the BOP Regulator Bypass flow control valve 607 to deliver selectable regulated fluid supplies to individual selector valves 606 (mounted to the integrated manifold assembly 600). The manifold assembly 600 includes #6 SAE pressure sensing ports to allow for installation of pressure switches 611 (relocated at the rear section). It also incorporates 4-way selector valve outlets at the top section 613 via #24 SAE port connections. All function outlets 613 are brought to the skid edge via 1.5" piping, allowing for different valve bodies (1" and 1.5") to be interchanged according to flow requirements. The internal porting size of the design has been enlarged from a typical 1" dimension to a 1.25" dimension. Lastly, two #24 SAE connection ports 609 provide interconnection between the manifold 603 and return lines, allowing for hydraulic fluid to return to the system's reservoir as needed.

Integrated manifold assembly 700 allows for the interconnection of components used for the operation of BOP Annular/Diverter Packer functions. The integrated manifold assembly 700 also features Namur mounting pads 701 located on each 4-way valve actuator which facilitate the mounting of solenoid valves 702. Integrated manifold assembly 700 incorporates an internally ported adapter which allows for two KR-140 FSA regulators 704 to mate in parallel when installed. In addition, the manifold assembly 700 includes two #16 SAE connection ports 708 used for the connection of sensing lines of pressure regulators 704. Individual ½" NPT inspection ports 712 are included at the manifold to allow for an ease of maintenance in case of fluid leakage. An adapter subplate assembly 713 is utilized to facilitate the mating of multiple regulators 704 in parallel with a Code62 common supply port 707. The subplate assembly 713 includes two ½" NPT ports used as vent connections. Similarly, adapter plates 705 are used to allow SVX-150 valves 706 to mate with the manifold 703. The manifold assembly includes #6 SAE pressure sensing ports to allow for installation of pressure switches 711 (not shown). It also incorporates 4-way selector valve outlets at the top section 710 via #24 SAE port connections. All function outlets 710 are brought to the skid edge via 1.5" piping, allowing for different valve bodies (1" or 1.5") to be interchanged according to volume requirements. Lastly, two #24 SAE connection ports 709 provide interconnection between the manifold 703 and return lines, allowing for hydraulic fluid to return to the system's reservoir as needed.

Integrated manifold assembly 800 allows for the interconnection of components used for the operation of the Shear Ram function. Similar to the previously described integrated manifold design, the Shear Ram integrated manifold 800 features Namur mounting pads 801 located on a 4-way selector valve actuator, used for the mounting of solenoid valves 802. The manifold features two 1" Code62 common supply ports 809, 810 used for the connection of hydraulic fluid supply lines to a KR-140 hydraulic regulator 808. An adapter plate assembly 804 can be used to allow for a SVX-100 or SVX-150 4-way selector valve 805 to mate with the manifold 806. Internal porting allows for the hydraulic regulator 808 to deliver regulated pressure to the function's 4-way selector valve 805. In addition, the integrated manifold incorporates two 1½" Code62 ports used as the 4-way selector valve's outlets; the ports are located at the top section 803 of the manifold. Moreover, the manifold includes two #6 SAE pressure sensing ports used to allow for installation of pressure switches 811. Similarly, a #16 SAE connection port 812 is included for the interconnection of the manifold 806 with pressure relief valve (BOM item 11), used to prevent over-pressurization of the system (if necessary). Lastly, two #8 SAE connection ports 813 provide interconnection between the regulator 808 and vent lines, while a #24 SAE connection port 807 provides interconnection between the manifold 806 and return lines; both connections allow for hydraulic fluid to return to the system's reservoir as needed.

FIG. 11.1 shows an isometric rear view of Hydraulic Manifold Control Assembly 1100. FIG. 11.2 shows a front isometric view of Hydraulic Manifold Control Assembly 1100, with panel valve assembly 1110, and front plate 1115, in exploded view. Hydraulic Manifold Control Assembly 1100 includes frame 1110, within which are mounted CPU Panel 900, Main Control Panel 100, solenoid valve EP panel 400, and plurality of pressure switches 611 (where said pressure sensors are mounted on the rear of manifold 600). Connections 1140 lead from valves 606 to the respective devices to be actuated (e.g., BOP shears/rams, diverter valves, etc.). Gauge panel 1150 includes a plurality of pressure gauges displaying pressure at various points within Hydraulic Manifold Control Assembly 1100. FIG. 12.1 shows a view of the left side of Hydraulic Manifold Control Assembly 1100. FIG. 12.2 shows a front view of Hydraulic Manifold Control Assembly 1100. FIG. 12.3 shows a right view of Hydraulic Manifold Control Assembly 1100. And, FIG. 12.4 shows a top view of Hydraulic Manifold Control Assembly 1100. FIGS. 12.1 and 12.2 show two separate accumulators 1210 which provide emergency air pressure for operation of actuators in the event that instrumentation air pressure is lost.

The present invention delivers a flow design that accounts for a wide-range function count. Conventionally, each project's design is deliberately prepared to satisfy detailed functional specifications provided; given that the amount of functions habitually vary from project to project. This limitation forces the design of each project to be customized in order to adapt to such specifications. The invention's design provides means of operating a total of 34 functions (7 BOP related functions, 15 Locks/Spares and 12 Diverter related functions). In order to satisfy a given project's specifications, the invention design provides the option of blanking-off any unnecessary functions. Therefore, the wide-range flow design deliberately adapts to the specific function requirements of each project, allowing for a uniform design to adapt to each project's variations. This unique design element enables the invention to have an ease of reproduction, thus delivering an improved control system design by reducing overall manufacturing time.

In operation, each of the various manifolds described above is provided constant hydraulic pressure from respective accumulator supply banks (not shown). This constant pressure is regulated upon entry into each manifold (see, e.g., regulators 604). Importantly the parallel configuration of these regulators allows for the provision of fluid at two different pressures without the harmonics often associated with regulators placed in series. Each valve mounted to a manifold (see, e.g., valves 606) is actuated either via compressed instrumentation air from solenoid valves 602, or via manual actuation via handles 510. Actuation via instrumentation air is accomplished via Main Control Panel 100 or one or more remote control panels, where the inputs and outputs of said panels are processed by a PLC in CPU Panel 900.

With respect to the operation of the pneumatic control system, air pressure flows to the solenoid valves 602, which are used to control direction of air pressure for remote operation of flow control valves 606. Filters, regulators, and lubricators are installed downstream of the supply port connection, used to regulate and condition the air pressure supply to satisfy the solenoid valves' air supply requirements. A pressure gauge/transmitter assembly is installed downstream of the regulator to provide local and remote pressure (e.g., Rig Air Supply Pressure) feedback to the operator. A block-and-bleed valve assembly 303 is installed upstream of the pressure gauge/transmitter assembly to allow for the device to be serviced without affecting the operation of the control system. The air pressure is used to actuate hydraulic flow control valves (e.g., valves 501). Two ten liter accumulators 1210 are installed upstream of the regulator. The accumulators are used to store air to allow the system's flow control valves to actuate twice without the need of air supply in case of a supply outage. A pressure gauge is installed upstream of the accumulator for local pressure feedback of the stored compressed air. Exemplary valves controlled by skid mounted flow control valves include: BOP Ram locks and valves, Fail Safe Valves (Choke/Kill), Spare functions, Flowline Seals, Overshot Packer, Spare Packer, and Diverter Manifold functions.

With respect to the operation of the BOP/Diverter hydraulic system, the hydraulic fluid supply (5000 psi) is delivered from the systems' accumulator bottles (not shown). The accumulator bottles are filled with pressurized hydraulic fluid (5000 psi) delivered by a Hydraulic Power Unit (HPU) 1050. A flowmeter is installed downstream of the supply port connection to provide a supply fluid flow and volume to the operator. Said flowmeter uses an electric pickoff device that provides digital count signals to PLC 1910. PLC 910 transfers the digital signals to the local and remote (at remote control panels) totalizers to provide feedback to the operator. A pressure gauge/transmitter assembly is installed downstream of the supply port connection to provide local and remote pressure (accumulated pressure) feedback to operator. A block-and-bleed valve assembly 303 is installed upstream of pressure gauge/transmitter assembly to allow for the device to be serviced without affecting the operation of the control system.

The pressurized hydraulic fluid (5000 psi) is delivered to integrated manifold assembly 700 (that delivers regulated fluid for operation of BOP Annular and Diverter Packer functions), integrated manifold assembly 600 (that delivers regulated fluid for operation of BOP functions), and 800 (that delivers fluid for operation of sheer functions), and associated regulators for functions requiring lower operating pressures. Hydraulic regulators are used to step-down the supply hydraulic fluid pressure from 5000 psi (delivered from the system's accumulator bottle units).

Integrated manifold assembly 700 includes two fail-safe air-driven hydraulic regulators 704 for regulation of fluid delivered to respective functions BOP Annular and Diverter Packer. A flow control valve is used to control delivery of regulated hydraulic fluid to the BOP Annular Preventer and Diverter Packer. Said regulators are mounted on the integrated manifold assembly 700 to allow for a single supply to distribute hydraulic fluid to both devices. Air-piloted flow control valves are used to control delivery of air pressure to each fail-safe air-driven hydraulic regulator (included within the integrated manifold assembly 700). Operation of the air-piloted flow control valves 706 is done locally or remotely. A manual handle is installed for the local operation of the air-piloted flow control valves 706. Solenoid valves 702 are used to control delivery of air for the remote actuation of the air-piloted flow control valves 706. Pressure gauge/transmitter assemblies are installed downstream of the integrated manifold assembly 700 to provide local and remote pressure (BOP Annular Pressure and Diverter Packer Pressure) feedback to operator. Block-and-bleed valve assemblies 303 are installed upstream of the pressure gauge/transmitter assemblies to allow for the devices to be serviced without affecting the operation of the control system.

Integrated manifold assembly 600 includes two hydraulic regulators 604. A flow control valve with bypass rotor 607 (attached to the integrated manifold assembly 600) is used to control delivery of either 3000 psi or 1500 psi to the BOP functions (mounted on integrated manifold assembly 600); including BOP Ram locks or Spare functions. Said regulators are installed to the manifold 600 to allow for a single line to distribute hydraulic fluid. The flow control valve with bypass rotor 607 (mounted to the integrated manifold assembly 600), offers two pressure modes for the operator to select 1500 psi or 3000 psi. Selection of either mode is done locally or remotely. Upon selecting a pressure mode, the regulated fluid is further delivered to the flow control valves of the BOP ram functions (mounted to the integrated manifold assembly (for example, valves connected to BOP Ram locks or Spare functions). Pressure gauges are installed downstream of the hydraulic regulators for local pressure feedback (hydraulic fluid). A pressure gauge/transmitter assembly is installed downstream of the integrated manifold assembly 600 to provide local and remote pressure (BOP Manifold Pressure) feedback to operator. A block-and-bleed valve assembly 303 is installed upstream of the pressure gauge/transmitter assembly to allow for the device to be serviced without affecting the operation of the control system.

A single regulator (Diverter Manifold Regulator) is used to regulate the hydraulic pressure delivered to a series of interconnected diverter functions. Furthermore, for functions with operating pressures below 3000 psi, three additional regulators can be utilized, (regulators available for regulated divert mode functions as applicable) stepping down pressure as needed. Pressure gauge/transmitter assemblies are installed downstream of regulators to provide local and remote pressure feedback to operator. Block-and-bleed valve assemblies 303 are installed upstream of the pressure gauge/transmitter assemblies to allow for the devices to be serviced without affecting operation of the control system.

If applicable, the pressurized hydraulic fluid (5000 psi) is also delivered to integrated manifold assembly 800 (when required) for the operation of the Shear Ram Shear function (discussed below in connection with a discussion of operation of the shear hydraulic system).

Individual regulated hydraulic fluid supply streams are supplied to the BOP Annular and Diverter Packer flow control valves (mounted to the integrated manifold assembly 700). Regulated hydraulic fluid flows through the control valve (for function being actuated) to the function's respective port connection at the bulkhead plate and is then delivered to the end function devices function port. Flow control valves can be operated both locally (manual operation) and remotely (automated operation). Pressure relief valves (PSV) are also installed to prevent over-pressurization of the system. Double check valves (connected in series) are used at each sensing circuit to prevent fluid pressure (due to a single point of failure) to flow into a parallel circuit (also connected to the same relief valve). In case of over-pressurization in the system: a return line port provides interconnection with the HPU's reservoir at the bulkhead allowing all hydraulic fluid to vent back to the system's reservoir at the HPU 1050. A manual needle valve is installed to allow hydraulic fluid to drain (back to fluid reservoir at the HPU), and release pressure from the system (as needed). A return line port provides interconnection with the HPU's reservoir at the bulkhead. A flowmeter is installed upstream of the return port connection to provide a return fluid flow and volume to the operator. The flowmeter uses an electric pickoff device that provides digital count signals to the PLC 910. The PLC 910 transfers the digital signals to the local and remote (at remote control panels) totalizers to provide feedback to the operator.

With regard to the operation of the hydraulic fluid supply (5000 psi) is delivered from either the Shear Assembly systems' or BOP/Diverter's accumulator bottle units, depending on the nature of the system setup. The accumulator bottles are filled with pressurized hydraulic fluid (5000 psi) delivered by a Hydraulic Power Unit (HPU) 1150. The pressurized hydraulic fluid (5000 psi) is delivered to an integrated manifold assembly 800. A hydraulic regulator 808 (attached to the integrated manifold assembly 800) is used to step-down the supply hydraulic fluid pressure as needed. A pressure gauge/transmitter assembly is installed downstream of the regulator to provide local and remote pressure (Shear Regulated Pressure) feedback to operator. A block-and-bleed valve assembly 303 is installed upstream of the pressure gauge/transmitter assembly to allow for the device to be serviced without affecting the operation of the control system. The Shear Ram function can be operated both locally (manual operation) and remotely (automated operation).

With regard to operation of port and starboard overboard valves, the system includes means of operating diverter functions Port Overboard and Starboard Overboard. The system is configured in such way were only one flow control valve of each function can be in the CLOSE position at a time. Shuttle valves are installed to control flow of air pressure to the pilot line of each of the function's flow control valve. Individual pressure sensors are installed downstream of each function's shuttle valve. The pressure sensors actuate upon sensing pressure from the function's respective CLOSE connection port. Actuation of each function (Port Overboard and Starboard Overboard) is accomplished by locally operating the Overboard Preselect functions via the Main Control Panel or remotely by operating the Remote Control Panel(s). A solenoid valve allows the system to be set to "Test mode". "Test mode" allows both functions (Port Overboard and Starboard Overboard) to be set in a CLOSE position at a time. Selection of "Test Mode" is accomplished locally by operating the Diverter Test function via the Main Control Panel.

With regard to manual operation of functions (e.g., rams, ram locks, valves, spares, and diverter functions), said operation is done by actuating the lever (e.g., lever 510) of the flow control valve of the function of interest. Regulated hydraulic fluid flows through flow control valve to the function's respective port connection at the bulkhead plate. Pressure switches (e.g., pressure switches 611) are installed to detect pressure downstream of the function's flow control valve. These switches deliver a digital signal to the Main Control Panel 100 upon detecting a set-point pressure. The digital signal provides feedback to the CPU (located at the CPU Panel 900). The feedback allows the CPU to deliver a digital output signal to indicating lamps/displays of each remote control panel. The indicating lamps/displays allow users to ensure the function of interest has successfully operated as expected, and provide live feedback of the state of each function.

With regard to the remote operation of functions (e.g., rams, ram locks, valves, spares, and diverter functions), such remote operation is done at remote control panel(s), through programmed HMI (Human Machine Interface) display. The HMI display is populated with pre-programmed digital push buttons. Actuation of the function push button delivers a signal (input) to the CPU unit, located at the CPU Panel 900. The HMI features an "Enable Push/Hold" button used to operate any function; allowing for the system to account for a two hand operation. The PLC 910 sends a signal (digital output) in response to the input signal (delivered by operating the HMI push button), actuating the respective function's solenoid valve. Actuation of the solenoid valve allows air pressure to flow and actuate the respective function's hydraulic flow control valve. Regulated hydraulic fluid flows through the flow control valve to the function's respective port connection at the unit's bulkhead plate. Pressure switches (e.g., pressure switches 611) are installed to detect pressure downstream of the function's flow control valve. These switches deliver a digital signal to the Main Control Panel 100 upon detecting a set-point pressure. The digital signal provides feedback to the CPU (located at the CPU Panel 900). The feedback allows the CPU to deliver a digital output signal to indicating lamps or display of each remote control panel. The indicating lamps allow users to ensure the function of interest has successfully operated as expected, and provide live feedback of the state of each function.

In an alternative embodiment (not shown), it is speculated that manifold 600 could be configured such that the various valves 606 are replaced with pocket valves which are hydraulically piloted, thereby eliminating the need for instrumentation air to actuate said valves. In another alternative embodiment, it is speculated that the electrical system described herein, which comprises of direct cable runs using intrinsically safe cabling (where possible), could be replaced with a bus-type communication and control system.

What is claimed is:

1. A hydraulic manifold control assembly comprising:

a frame, wherein said frame defines an outer perimeter;

a processing unit;

a control panel, comprising a push button and an indicator, wherein said control panel is in communication with said processing unit;

a solenoid rack module comprising a solenoid, a valve, and a compressed air line, wherein said solenoid rack module is in communication with said processing unit, wherein said solenoid is operable to open or close said valve in response to receiving a signal, and wherein opening and closing of said valve controls a flow of compressed air in said compressed air line;

a first integrated manifold assembly comprising: a first manifold, wherein said first manifold is operable to receive hydraulic fluid under a first pressure; and a first regulator attached to said first manifold, wherein said first regulator attached to said first manifold is operable to regulate a first available internal pressure of said hydraulic fluid within said first manifold;

a flow control valve, wherein said flow control valve is mounted to said first manifold, wherein said flow control valve is connected to said processing unit, and wherein said flow control valve is operable to receive and redirect said hydraulic fluid from said manifold to a location exterior to said hydraulic manifold control assembly;

a valve assembly rack, wherein said flow control valve is mounted to said valve assembly rack and wherein said valve assembly rack is configured to allow for access to said flow control valve from a front side of said frame; and, a removeable function plate, wherein said removeable function plate is attached to said valve assembly rack on said front side of said frame, and wherein said removeable function plate is operable to be removed from said valve assembly rack without first removing said flow control valve;

wherein one or more of said control panel, said processing unit, said solenoid rack module, said first integrated manifold assembly, said flow control valve, said valve assembly rack, and said removeable function plate are mounted to said frame.

2. The hydraulic manifold control assembly of claim 1, wherein one or more of said control panel, said processing unit, said solenoid rack module, said first integrated manifold assembly, said flow control valve, said valve assembly rack, and said removeable function plate are configured to fit within said outer perimeter of said frame.

3. The hydraulic manifold control assembly of claim 1, wherein one or more of said processing unit, said control panel, and said solenoid rack module comprise intrinsically safe components.

4. The hydraulic manifold control assembly of claim 3, wherein said first integrated manifold assembly further comprises a second regulator, wherein said second regulator is configured so that it is in parallel with said first regulator, and wherein said second regulator is operable to regulate a second available internal pressure of said hydraulic fluid within said first manifold.

5. The hydraulic manifold control assembly of claim 4, further comprising a CPU panel, wherein said processing unit is housed within said CPU panel.

6. The hydraulic manifold control assembly of claim 5, further comprising a solenoid panel, wherein said solenoid rack module is housed within said solenoid panel.

7. The hydraulic manifold control assembly of claim 6, further comprising a plurality of solenoid rack modules, wherein each solenoid rack module of said plurality of solenoid rack modules is housed within said solenoid panel.

8. The hydraulic manifold control assembly of claim 7, further comprising a plurality of flow control valves, wherein said plurality of flow control valves is mounted to said valve assembly rack, and wherein each compressed air line associated with each of said solenoid rack modules of said plurality of solenoid rack modules is connected to a flow control valve of said plurality of said flow control valves.

9. The hydraulic manifold control assembly of claim 8, wherein a given flow control valve of said plurality of flow control valves is operable to operate in response to pressure changes in the compressed air line connected to said given flow control valve;

and, wherein said solenoid attached to said compressed air line connected to said given flow control valve is operable to operate in response to a signal received from said processing unit.

10. The hydraulic manifold control assembly of claim 4, further comprising a second integrated manifold assembly comprising:

a second manifold, wherein said second manifold is not directly connected to said first manifold, and wherein said second manifold is configured to receive hydraulic fluid under a first pressure;

a first regulator attached to said second manifold, wherein said first regulator attached to said second manifold is operable to regulate a first available internal pressure of said hydraulic fluid within said second manifold; and, a second regulator attached to said second manifold, wherein said second regulator attached to said second manifold is configured so that it is in parallel with said first regulator attached to said second manifold, and wherein said second regulator attached to said second manifold is operable to regulate a second available internal pressure of said hydraulic fluid within said second manifold.

11. The hydraulic manifold control assembly of claim 10, further comprising a third integrated manifold assembly comprising:

a third manifold, wherein said third manifold is not directly connected to said first manifold or said second manifold, and wherein said third manifold is configured to receive hydraulic fluid under a first pressure; and, a first regulator attached to said third manifold, wherein said first regulator attached to said third manifold is operable to regulate a first available internal pressure of said hydraulic fluid within said third manifold.

12. The hydraulic manifold control assembly of claim 11, wherein each of said control panel, said CPU panel, said solenoid panel, said first integrated manifold assembly, said second integrated manifold assembly, said third integrated manifold assembly, said flow control valve, said valve assembly rack, and said removeable function plate are configured to fit within said outer perimeter of same frame.

13. The hydraulic manifold control assembly of claim 3, wherein said flow control valve is operable via either manual control or remote control.

14. A hydraulic manifold control assembly comprising:

a frame, wherein said frame defines an outer perimeter;

a means for processing inputs and providing control outputs;

a means for interfacing with said processing means;

a means for providing compressed air for instrumentation control;

a means for distributing pressurized hydraulic fluid to a plurality of valves, said distribution means further comprising a means for regulating the pressure of said hydraulic fluid;

a flow control valve, wherein said flow control valve is mounted to said distribution means, wherein said flow control valve is connected to said means for providing compressed air, and wherein said flow control valve is operable to receive and redirect said hydraulic fluid from said distribution means to a location exterior to said hydraulic manifold control assembly;

a valve assembly rack, wherein said flow control valve is mounted to said valve assembly rack and wherein said valve assembly rack is configured to allow for access to said flow control valve from a front side of said frame;

a removeable function plate, wherein said removeable function plate is attached to said valve assembly rack on said front side of said frame, and wherein said removeable function plate is operable to be removed from said valve assembly rack without first removing said flow control valve;

wherein one or more of said interfacing means, said control means, said means for providing compressed air, said distribution means, said flow control valve, said valve assembly rack, and said removeable function plate are mounted to said frame.

15. The hydraulic manifold control assembly of claim 14, wherein each of said interfacing means, said processing means, said means for providing compressed air, said distribution means, said flow control valve, said valve assembly rack, and said removeable function plate are configured to fit within said outer perimeter of said frame.

16. The hydraulic manifold control assembly of claim 14, wherein one or more of said interfacing means, said processing means, and said means for providing compressed air comprise intrinsically safe components.

17. The hydraulic manifold control assembly of claim 16, wherein said distribution means further comprises a second regulator, wherein said second regulator is configured so that it is in parallel with said first regulator, and wherein said second regulator is operable to regulate a second available internal pressure of said hydraulic fluid within said manifold.

18. The hydraulic manifold control assembly of claim 17, further comprising a plurality of flow control valves, wherein each flow control valve of said plurality of flow control valves is mounted to said valve assembly rack, and wherein each said flow control valve is connected to said means for providing compressed air.

19. The hydraulic manifold control assembly of claim 18, wherein a given flow control valve of said plurality of flow control valves is operable to operate in response to changes in air pressure provided by said means for providing compressed air; and, wherein said means for providing compressed air is operable to operate in response to a signal received from said processing means.

20. The hydraulic manifold control assembly of claim 14, wherein said flow control valve is operable via either manual control or remote control.

* * * * *